United States Patent [19]

Rokutanzono et al.

[11] Patent Number: 5,008,172

[45] Date of Patent: Apr. 16, 1991

[54] ELECTROPHOTOGRAPHIC PHOTOCONDUCTOR

[75] Inventors: Takashi Rokutanzono, Numazu; Yukio Ide, Mishima; Hiroshi Nagame, Numazu; Kohichi Ohshima, Mishima; Narihito Kojima; Shinji Nousho, both of Numazu, all of Japan

[73] Assignee: Ricoh Company, Ltd., Tokyo, Japan

[21] Appl. No.: 356,140

[22] Filed: May 24, 1989

[30] Foreign Application Priority Data

May 26, 1988 [JP] Japan ..... 63-126949

[51] Int. Cl.[5] ..... G03G 15/04

[52] U.S. Cl. ..... 430/67; 430/66

[58] Field of Search ..... 430/66, 67

[56] References Cited

U.S. PATENT DOCUMENTS

| | | | |
|---|---|---|---|
| 4,007,050 | 2/1977 | Läufer et al. | 106/483 |
| 4,426,435 | 1/1984 | Oka | 430/132 |
| 4,444,802 | 4/1984 | Yagi et al. | 430/67 |
| 4,515,882 | 5/1985 | Mammino et al. | 430/58 |
| 4,618,556 | 10/1986 | Takenouchi et al. | 430/110 |
| 4,657,835 | 4/1987 | Yashiki | 430/60 |
| 4,912,000 | 3/1990 | Kumakura et al. | 430/67 |

FOREIGN PATENT DOCUMENTS

| | | | |
|---|---|---|---|
| 0102944 | 6/1983 | Japan | 430/67 |
| 2206559 | 9/1987 | Japan | 430/66 |

*Primary Examiner*—Marion E. McCamish
*Assistant Examiner*—S. Crosson
*Attorney, Agent, or Firm*—Oblon, Spivak, McClelland, Maier & Neustadt

[57] ABSTRACT

An electrophotographic photoconductor is disclosed, which comprises an electroconductive substrate, a photoconductive layer formed on the electroconductive substrate, and a protective layer formed on the photoconductive layer, the protective layer comprising a binder resin and finely-divided particles of at least one metal oxide with the surface thereof being coated with a coupling agent selected from the group consisting of a titanate-type coupling agent, a fluorine-containing silane coupling agent, and an acetoalkoxyaluminum diisopropylate, dispersed in the binder resin.

14 Claims, No Drawings

ELECTROPHOTOGRAPHIC PHOTOCONDUCTOR

BACKGROUND OF THE INVENTION

1. Field of the Invention

This invention relates to an electrophotographic photoconductor, and more particularly to an electrophotographic photoconductor comprising a photoconductive layer and a protective layer formed thereon, which comprises a binder resin and finely-divided particles of at least one metal oxide with the surface thereof being coated with a coupling agent selected from the group consisting of a titanate-type coupling agent, a fluorine-containing silane coupling agent, and an acetoalkoxylaluminum diisopropylate, dispersed in the binder resin.

2. Discussion of Background

Hitherto the following electrophotographic photoconductors have been generally known: an electrophotographic photoconductor in which a photoconductive layer comprising Se or a Se alloy as the main component is formed on an electroconductive substrate; an electrophotographic photoconductor which comprises a photoconductive layer prepared by dispersing an inorganic photoconductive material such as zinc oxide or cadmium sulfide in a binder resin; an electrophotographic photoconductor which comprises a photoconductive layer prepared by using organic photoconductive materials such as poly-N-vinyl-carbazole and trinitro fluorenone or an azo pigment; and an electrophotographic photoconductor which comprises a photoconductive layer prepared by using amorphous silicon.

Reliable electrophotographic photoconductors capable of maintaining high image quality for a prolonged period are now strongly demanded.

The photoconductive layer of the conventional photoconductor, when not protected, but exposed, tends to be physically or chemically damaged by corona charging during the charging thereof, or when brought into contact with other members of a copying machine in the course of copying process. Such a damage shortens the expected life span of the photoconductor.

In order to overcome the above shortcoming, photoconductive layers coated with a protective layer have been proposed; for instance, a photoconductive layer coated with an organic film as disclosed in Japanese Patent Publication 38-15446, a photoconductive layer coated with a layer of an inorganic oxide compound as disclosed in Japanese Patent Publication 43-14517, a photoconductive layer coated with an insulating layer through an adhesive layer as disclosed in Japanese Patent Publication 43-27591, and photoconductive layers coated with an a-Si layer, an a-Si:N:H layer and an a-Si:O:H, respectively, by a plasma or light chemical vapor deposition method as disclosed in Japanese Laid-open Patent Applications 57-179859 and 59-58437.

However, when the protective layer has high resistance, for instance, $10^{14}$ Ω·cm or more, the residual electric potential of the photoconductor increases and the electric charge is built up during repeated use of the photoconductor. Therefore such a protective layer cannot be practically used.

Some protective layers have been proposed so as to eliminate the above drawbacks; for instance, protective layers which also serve as photoconductive layers as disclosed in Japanese Patent Publications 48-38427, 43-16198 and 48-10258, and U.S. Pat. No. 2,901,348; protective layers containing charge transporting materials such as dyes and Lewis acids as disclosed in Japanese Patent Publication 44-834 and Japanese Laid-open Patent Application 53-133444; and a protective layer containing metals or finely-divided particles of metal oxides, which can serve as a resistance-controlling agent, as disclosed in Japanese Laid-open Patent Application 53-3338.

The above protective layers, however, absorb light, so that the quantity of light which reaches the photoconductive layer decreases. As a result, the photosensitivity of the photoconductor is decreased by the protective layers.

The above shortcoming can be overcome by a protective layer, disclosed in Japanese Laid-open Patent Application 57-30846, in which finely-divided particles of a metal oxide having an average diameter of 0.3 μm or less are dispersed as a resistivity-controlling agent so that the protective layer is substantially transparent to visible light. Therefore, a photoconductor comprising such a protective layer can maintain high photosensitivity. Furthermore, since the photoconductive layer is mechanically strengthened by the presence of the finely-divided particles of a metal oxide therein, the durability of the photoconductor is highly enhanced.

However, it has been found that the so-called image flow is caused when copy making is performed by employing the above photoconductor for an extended period of time, or at high humidities or in an atmosphere in which the humidity is drastically changed.

For preventing the image flow, a method is disclosed in Japanese Laid-open Patent Application 62-295066, in which metals or finely divided particles of a metal oxide to be dispersed in a protective layer are subjected to a surface-treatment so as to impart water-repellency.

This method, however, is still insufficient for preventing the image flow, and moreover some adverse side effects such as increasing of the residual electric potential of the photoconductor are caused.

SUMMARY OF THE INVENTION

Accordingly, an object of the present invention is to provide an electrophotographic photoconductor which comprises a protective layer having high transparency, mechanical strength and stability against the changes in the environmental conditions such as humidity, and is capable of providing high quality images constantly for a prolonged period of time.

The above object of the invention can be attained by an electrophotographic photoconductor comprising an electroconductive substrate, a photoconductive layer formed on the electroconductive substrate, and a protective layer formed on the photoconductive layer, the protective layer comprising a binder resin and finely-divided particles of at least one metal oxide with the surface thereof being coated with a coupling agent selected from the group consisting of a titanate-type coupling agent, a fluorine-containing silane coupling agent, and an acetoalkoxylaluminum diisopropylate, dispersed in the binder resin.

DESCRIPTION OF THE PREFERRED EMBODIMENTS

Examples of the materials of the finely-divided particles of a metal oxide for the protective layer are tin oxide, zinc oxide, titanium oxide, indium oxide, antimony oxide, bismuth oxide, tin oxide doped with antimony, and indium oxide doped with tin. These metal oxide particles can be used, singly or in combination, in the protective layer in the present invention. The average diameter of the finely-divided particles of the metal oxide is preferably 0.3 μm or less, more preferably 0.1 μm or less, when the transparency of the protective layer is taken into consideration.

The surface-treatment of the finely-divided particles of the metal oxide is conducted by mixing the particles in a solution which is prepared by dissolving a titanate-type coupling agent, a fluorine-containing silane coupling agent, and/or acetoalkoxylaluminum diisopropyrate in an appropriate solvent in an amount of 0.1 to 10 wt.%; mixing the mixture; removing the solvent; and drying the resulting product. Thus, surface-treated finely-divided particles of the metal oxide can be obtained. The above solution may further contain a catalyst which accelerates the reaction for the surface-treatment.

Examples of the titanate-type coupling agent for use in the present invention include:
isopropyltriisostearoyl titanate,
isopropyltris(dioctylpyrophosphate) titanate,
isopropyltri(N-aminoethyl-aminoethyl) titanate,
tetraoctylbis(ditridecylphosphite) titanate,
tetra(2,2-diallyloxymethyl-1-butyl)bis(ditridecyl) -phosphite titanate,
bis(dioctylpyrophosphate)oxyacetate titanate,
bis(dioctylpyrophosphate)ethylene titanate,
isopropyltrioctanoyl titanate,
isopropyldimethacrylisostearoyl titanate,
isopropyltridodecylbenzenesulfonyl titanate,
isopropylisostearoyldiacryl titanate,
isopropyltri(dioctylphosphate) titanate,
isopropyltricumylphenyl titanate, and
tetraisopropylbis(dioctylphosphite) titanate.

Examples of the fluorine-containing silane coupling agent for use in the present invention include:
$C_4F_9CH_2CH_2Si(OCH_3)_3$,
$C_8F_{17}CH_2CH_2Si(OCH_3)_3$, $$C_8F_{17}CH_2CH_2\underset{\underset{CH_3}{|}}{Si}(OCH_3)_2,$$

$C_7F_{15}COOCH_2CH_2CH_2Si(OCH_3)_3$,
$C_7F_{15}COSCH_2CH_2CH_2Si(OCH_3)_3$,
$C_7F_{15}CONHCH_2CH_2CH_2Si(OC_2H_5)_3$,
$C_7F_{15}CONHCH_2CH_2CH_2Si(OCH_3)_3$,
$C_8F_{17}SO_2NHCH_2CH_2CH_2Si(OC_2H_5)_3$, $$C_8F_{17}SO_2\underset{\underset{CH_2CH_2CH_3}{|}}{N}CH_2CH_2CH_2Si(OCH_3)_3,$$

$C_8F_{17}CH_2CH_2SCH_2CH_2Si(OCH_3)_3$,
$C_{10}F_{21}CH_2CH_2SCH_2CH_2Si(OCH_3)_3$, $$C_7F_{15}CONHCH_2CH_2\underset{\underset{COC_7F_{15}}{|}}{N}CH_2CH_2CH_2Si(OCH_3)_3, \text{ and}$$

$$C_8F_{17}SO_2NHCH_2CH_2\underset{\underset{SO_2C_8F_{17}}{|}}{N}CH_2CH_2CH_2Si(OCH_3)_3.$$

Examples of the acetoalkoxylaluminum diisopropylate for use in the present invention include acetomethoxyaluminum diisopropylate, acetoethoxyaluminum isopropylate, and acetopropoxyaluminum diisopropylate.

Examples of the binder resin for use in the present invention include silicone resin, polyurethane resin, acryl resin, polyester resin, polycarbonate resin, polystyrene resin, and epoxy resin.

In the present invention, the protective layer can be formed on the photoconductive layer in the following manner: surface-treated, finely-divided particles of the metal oxide with the titanate-type coupling agent, the fluorine-containing silane coupling agent or acetoalkoxylaluminum diisopropylate in the aforementioned manner are dispersed in a solution of any of the above binder resins. The resulting dispersion is applied to the photoconductive layer, and then dried, thereby obtaining the desired protective layer.

In order to improve the dispersibility of the finely-divided particles of the metal oxide, the adhesion between the protective layer and the photoconductive layer, and the smoothness of the surface of the protective layer, various auxiliary agents may be added to the protective layer in the present invention.

The photoconductive layer for use in the present invention can be prepared by dispersing Se, Se alloys such as Se-Te and $As_2Se_3$, II-, III-, IV-, V- or VI-group compounds such as ZnO, CdS and CdSe in the binder resin; or made of an organic photoconductive material such as polyvinylcarbazole; or amorphous silicon.

There is no restriction to the structure of the photoconductive layer for use in the present invention. Namely, both a single layer type and a double layer type consisting of a charge generating layer and a charge transporting layer can be employed.

In order to enhance the adhesion between the protective layer and the photoconductive layer, an adhesive layer can be interposed therebetween. An electric barrier layer for preventing the penetration of electric charge into the photoconductive layer can also be formed between the photoconductive layer and the protective layer.

Electroconductive materials and insulating materials can be used as the electroconductive substrate in the present invention. Examples of such materials include: metals such as Al, Ni, Fe, Cu and Au, and alloys therof; insulating substrates such as polyester, polycarbonate, polyimide and glass coated with a thin film of metal such as Al, Ag or Au, or a thin film of a conductive material such as $In_2O_3$ or $SnO_2$; and paper coated with an electroconductive material.

The electroconductive substrates in any shape such as of plate, drum and belt are usable in the present invention, and a proper shape is chosen depending on the purpose.

Other feature of this invention will become apparent in the course of the following description of exemplary embodiments, which are given for illustration of the invention and are not intended to be limiting thereof.

COMPARATIVE EXAMPLE 1

An aluminum drum having a diameter of 80 mm and a length of 340 mm subjected to a pretreatment of cleaning was placed in an apparatus for vacuum deposition. Vacuum deposition of $As_2Se$ alloy by use of a heated resistor was conducted under the following conditions to form an $As_2Se_3$ alloy layer having a thickness of 60 μm on the surface of the aluminum drum, thereby preparing a photoconductive layer.

Conditions for Vacuum Deposition

Vacuum degree: $3\times10^{-6}$ Torr
Temperature of the substrate: 200° C.
Temperature of the boat: 450° C.

A ligroin solution of a silicone resin (Trademark "AY42-441", made by Toray Silicone Co., Ltd.) was applied to the above-prepared photoconductive layer to form an intermediate layer having a thickness of 0.2 μm.

The photoconductive layer coated with the intermediate layer was dipped into a dispersion prepared by dispersing 30 parts by weight of a styrene - methacrylate - acrylic acid - N-methylol acrylamide resin solution (the content of solid components: 40 wt.%) and 18 parts by weight of tin oxide with a proper amount of solvent in a ball mill for 100 hours, and then dried at 120° C. for 30 minutes to form a protective layer having a thickness of 5 μm on the intermediate layer, whereby a comparative electrophotographic photoconductor No. 1 was prepared.

COMPARATIVE EXAMPLE 2

50 parts by weight of tin oxide were added to a solution consisting of 5 parts by weight of γ-methacryloxypropyltrimethoxy silane (a silane coupling agent, Trademark "KBM-503", made by Shin-Etsu Chemical Co., Ltd.), 495 parts by weight of water and 0.5 parts by weight of acetic acid, and the mixture was stirred for two hours. The water was removed from the mixture by filtration, and the remaining product was dried at 120° C. for two hours, thereby obtaining water-repellent finely-divided particles of tin oxide coated with the silane coupling agent.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby a comparative electrophotographic photoconductor No. 2 was prepared.

EXAMPLE 1

50 parts by weight of tin oxide were added to a solution consisting of 5 parts by weight of $C_7F_{15}CO_2(CH_2)_3Si(OCH_3)_3$ (a fluorine-containing silane coupling agent, made by Mitsubishi Metal Corporation) and 495 parts by weight of methanol, and the mixture were stirred for two hours. The methanol was removed from the mixture by filtration, and the remaining product was dried at 120° C. for two hours, thereby obtaining finely-divided particles of tin oxide coated with the fluorine-containing silane coupling agent.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby an electrophotographic photoconductor No. 1 according to the present invention was prepared.

EXAMPLE 2

50 parts by weight of tin oxide were added to a solution consisting of 5 parts by weight of $$C_8F_{17}SO_2\underset{\underset{CH_2CH_2CH_3}{|}}{N}(CH_2)_3Si(OCH_3)_3$$

(a fluorine-containing silane coupling agent, made by Mitsubishi Metal Corporation) and 495 parts by weight of methanol, and the mixture was stirred for two hours. The methanol was removed from the mixture by filtration, and the remaining product was dried at 120° C. for two hours, thereby obtaining finely-divide particles of tin oxide coated with the fluorine-containing silane coupling agent.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby an electrophotographic photoconductor No. 2 according to the present invention was prepared.

EXAMPLE 3

50 parts by weight of tin oxide were added to a solution consisting of 5 parts by weight of isopropyltriisostearoyl titanate (a titanate-type coupling agent, Trademark "KR TTS", made by Ajinomoto Co., Inc.) and 495 parts by weight of hexane, and the mixture was stirred for two hours. The hexane was removed from the mixture by filtration, and the remaining product was dried at 120° C. for two hours, thereby obtaining finely-divided particles of tin oxide coated with the titanate-type coupling agent.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby an electrophotographic photoconductor No. 3 according to the present invention was prepared.

EXAMPLE 4

50 parts by weight of tin oxide were added to a solution consisting of 5 parts by weight of isopropyltris(dioctylpyrophosphate) titanate (a titanate-type coupling agent, Trademark "KR38S", made by Ajinomoto Co., Inc.) and 495 parts by weight of hexane, and the mixture was stirred for two hours. The hexane was removed from the mixture by filtration, and the remaining product was dried at 120° C. for two hours, thereby preparing finely-divided particles of tin oxide coated with the titanate-type coupling agent.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby an electrophotographic photoconductor No. 4 according to the present invention was prepared.

EXAMPLE 5

50 parts by weight of tin oxide were added to a solution consisting of 5 parts by weight of acetoethoxyaluminum diisopropylate (an acetoalkoxylaluminum diisopropylate, Trademark "AL-M", made by Ajinomoto Co., Inc.) and 495 parts by weight of hexane, and the mixture was stirred for two hours. The hexane was removed from the mixture by filtration, and the remaining product was dried at 120° C. for two hours, thereby obtaining finely-divided particles of tin oxide coated with acetoalkoxylaluminum diisopropylate.

A photoconductive layer coated with an intermediate layer was prepared in the same manner as in Comparative Example 1. Thereafter, it was dipped into a dispersion prepared by dispersing 30 parts by weight of a styrene - methacrylate - acrylic acid - N-methylol acrylamide resin solution (the content of solid components: 40 wt.%) and 18 parts by weight of the above-prepared finely-divided particles of tin oxide with a proper amount of solvent in a ball mill for 100 hours, and then dried at 120° C. for 30 minutes to form a protective layer having a thickness of 5 μm on the intermediate layer, whereby an electrophotographic photoconductor No. 5 according to the present invention was prepared.

The above prepared electrophotographic photoconductors Nos. 1 to 5 according to the present invention and the comparative electrophotographic photoconductors Nos. 1 and 2 were evaluated with respect to the resolution and residual electric potential thereof. The evaluation was made in the following manner.

By using each electrophotographic photoconductor, images were continuously reproduced on 100,000 sheets of copying paper at a temperature of 30° C. and a relative humidity of 90%, and the resolution was evaluated from the reproduced images. The residual potential at a temperature of 20° C. and a relative humidity of 65% was also measured. The results are shown in Table 1.

TABLE 1

| Photoconductor | Resolution (lines/mm) Initial | Resolution (lines/mm) Final | Residual Potential |
|---|---|---|---|
| Comp. No. 1 | 6 | — | 70 V |
| Comp. No. 2 | 6 | 4 | 120 V |
| No. 1 | 6 | 6 | 30 V |
| No. 2 | 6 | 6 | 30 V |
| No. 3 | 6 | 6 | 10 V |
| No. 4 | 6 | 6 | 10 V |
| No. 5 | 6 | 6 | 30 V |

In the table:
"(Resolution of) Final" is the resolution of images reproduced on the 100,000th sheet of copying paper; and
"—" means that images were not resolved.

The data shown in Table 1 demonstrate that the electrophotographic photoconductors according to the present invention indicate considerably lower residual potentials than the comparative ones, and give good image characteristics with high resolution even under the condition of high humidity.

As described above, the electrophotographic photoconductors according to the present invention are unchanged even when they are used under the conditions of high humidity for a prolonged period, and are capable of constantly producing high quality images.

What is claimed is:

1. An electrophotographic photoconductor comprising an electroconductive substrate, a photoconductive layer formed on said electroconductive substrate, and a protective layer formed on said photoconductive layer, said protective layer comprising a binder resin and finely-divided particles of at least one metal oxide with the surface thereof being coated with a coupling agent selected from the group consisting of a titanate-type coupling agent, a fluorine-containing silane coupling agent, and an acetoalkoxylaluminum diisopropylate, dispersed in said binder resin.

2. The electrophotographic photoconductor as claimed in claim 1, wherein said coupling agent is a titanate-type coupling agent.

3. The electrophotographic photoconductor as claimed in claim 2, wherein said titanate-type coupling agent is selected from the group consisting of:

isopropyltriisostearoyl titanate,
isopropyltris(dioctylpyrophosphate) titanate,
isopropyltri(N-aminoethyl-aminoethyl) titanate,
tetraoctylbis(ditridecylphosphate) titanate,
tetra(2,2-diallyloxymethyl-1-butyl)bis(ditridecyl) -phosphite titanate,
bis(dioctylpyrophosphate)oxyacetate titanate,
bis(dioctylpyrophosphate)ethylene titanate,
isopropyltrioctanoyl titanate,
isopropyldimethacrylisostearoyl titanate,
isopropyltridodecylbenzenesuphonyl titanate,
isopropylisostearoyldiacryl titanate,
isopropyltri(dioctylphosphate) titanate,
isopropyltricumylphenyl titanate, and
tetraisopropylbis(dioctylphosphite) titanate.

4. The electrophotographic photoconductor as claimed in claim 1, wherein said coupling agent is a fluorine-containing silane coupling agent.

5. The electrophotographic photoconductor as claimed in claim 3, wherein said fluorine-containing silane coupling agent is selected from the group consisting of:

$C_4F_9CH_2CH_2Si(OCH_3)_3$,
$C_8F_{17}CH_2CH_2Si(OCH_3)_3$, $$C_8F_{17}CH_2CH_2\underset{\underset{CH_3}{|}}{Si}(OCH_3)_2,$$

$C_7F_{15}COOCH_2CH_2CH_2Si(OCH_3)_3$,
$C_7F_{15}COSCH_2CH_2CH_2Si(OCH_3)_3$,
$C_7F_{15}CONHCH_2CH_2CH_2Si(OC_2H_5)_3$,
$C_7F_{15}CONHCH_2CH_2CH_2Si(OCH_3)_3$,
$C_8F_{17}SO_2NHCH_2CH_2CH_2Si(OC_2H_5)_3$, $$C_8F_{17}SO_2\underset{\underset{CH_2CH_2CH_3}{|}}{N}CH_2CH_2CH_2Si(OCH_3)_3,$$

$C_8F_{17}CH_2CH_2SCH_2CH_2Si(OCH_3)_3$,
$C_{10}F_{21}CH_2CH_2SCH_2CH_2Si(OCH_3)_3$, $$C_7F_{15}CONHCH_2CH_2\underset{\underset{COC_7F_{15}}{|}}{N}CH_2CH_2CH_2Si(OCH_3)_3, \text{ and}$$

$$C_8F_{17}SO_2NHCH_2CH_2\underset{\underset{SO_2C_8F_{17}}{|}}{N}CH_2CH_2CH_2Si(OCH_3)_3.$$

6. The electrophotographic photoconductor as claimed in claim 1, wherein said coupling agent is an acetoalkoxylaluminum diisopropylate.

7. The electrophotographic photoconductor as claimed in clam 4, wherein said acetoalkoxylaluminum diisopropylate is selected from the group consisting of acetomethoxyaluminum diisopropylate, acetoethoxyaluminum isopropylate, and acetopropoxyaluminum diisopropylate.

8. The electrophotographic photoconductor as claimed in claim 1, wherein said metal oxide is selected from the group consisting of tin oxide, zinc oxide, titanium oxide, indium oxide, antimony oxide, bismuth oxide, tin oxide doped with antimony, and indium oxide doped with tin.

9. The electrophotographic photoconductor as claimed in claim 1, wherein the average diameter of said finely-divided particles of said metal oxide is 0.3 μm or less.

10. The electrophotographic photoconductor as claimed in claim 1, wherein said binder resin is selected from the group consisting of silicone resin, polyurethane resin, acryl resin, polyester resin, polycarbonate resin, polystyrene resin and epoxy resin.

11. The electrophotographic photoconductor as claimed in claim 1, wherein said photoconductive layer comprises a material selected from the group consisting of Se, Se alloys, II-group compounds, III-group compounds, IV-group compounds, V-group compounds, VI-group compounds, organic photoconductive materials, and amorphous silicon.

12. The electrophotographic photoconductor as claimed in claim 1, further comprising an adhesive layer between said protective layer and said photoconductive layer.

13. The electrophotographic photoconductor as claimed in claim 1, further comprising an electrical barrier layer between said protective layer and said photoconductive layer.

14. An electrophotographic photoconductor as claimed in claim 1 in which the coating of the surface of the metal oxide particle with the said coupling agent is achieved by mixing the particles with a solution of the coupling agent to obtain treated particles and drying the treated particles.

* * * * *

UNITED STATES PATENT AND TRADEMARK OFFICE

CERTIFICATE OF CORRECTION

PATENT NO. : 5,008,172

DATED : April 16, 1991

INVENTOR(S) : ROKUTANZONO ET AL.

It is certified that error appears in the above-identified patent and that said Letters Patent is hereby corrected as shown below:

Column 3, lines 13-14, change "diisopropyrate" to --diisopropylate--.

Column 4, line 55, change "feature" to --features--.

Column 5, line 53, change "were" to --was--.

Column 6, line 18, change "divide" to --divided--.

Signed and Sealed this

Second Day of March, 1993

*Attest:*

STEPHEN G. KUNIN

*Attesting Officer*

*Acting Commissioner of Patents and Trademarks*